US008453264B2

(12) United States Patent
Mickle et al.

(10) Patent No.: US 8,453,264 B2
(45) Date of Patent: Jun. 4, 2013

(54) MULTI-LAYER PASSIVE WATER BARRIER SYSTEM

(75) Inventors: William K. Mickle, Baltimore, MD (US); Jason Berns, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 211 days.

(21) Appl. No.: 12/750,663

(22) Filed: Mar. 30, 2010

(65) Prior Publication Data

US 2010/0242149 A1 Sep. 30, 2010

Related U.S. Application Data

(60) Provisional application No. 61/165,219, filed on Mar. 31, 2009.

(51) Int. Cl.
*A41D 13/12* (2006.01)

(52) U.S. Cl.
USPC ..... 2/82; 2/94

(58) Field of Classification Search
USPC ..... 2/82, 85, 87, 93, 97; 454/270
See application file for complete search history.

(56) References Cited

U.S. PATENT DOCUMENTS

| | | | | |
|---|---|---|---|---|
| 385,306 | A | 6/1888 | Helwitz | |
| 3,228,821 | A * | 1/1966 | Trope | 428/136 |
| 4,569,874 | A * | 2/1986 | Kuznetz | 428/109 |
| 4,731,883 | A * | 3/1988 | Foster | 2/69 |
| 5,526,532 | A * | 6/1996 | Willard | 2/69 |
| 5,631,074 | A * | 5/1997 | Herlihy, Jr. | 442/35 |
| 5,704,064 | A * | 1/1998 | van der Sleesen | 2/69 |
| 5,752,277 | A * | 5/1998 | van der Sleesen | 2/69 |
| 6,085,353 | A * | 7/2000 | van der Sleesen | 2/69 |
| 6,263,511 | B1 * | 7/2001 | Moretti | 2/97 |
| 6,308,344 | B1 | 10/2001 | Spink | |
| 6,379,753 | B1 | 4/2002 | Soane et al. | |
| 6,442,760 | B2 * | 9/2002 | Moretti | 2/115 |
| 6,833,333 | B2 | 12/2004 | Reisdorf et al. | |
| 6,848,119 | B2 * | 2/2005 | Crye et al. | 2/247 |
| 6,868,557 | B1 * | 3/2005 | van der Sleesen | 2/93 |
| 6,918,140 | B1 * | 7/2005 | Cooper | 2/228 |
| 7,043,767 | B2 * | 5/2006 | Jaeger | 2/87 |
| 2003/0033656 | A1 * | 2/2003 | Jaeger | 2/69 |
| 2006/0041990 | A1 * | 3/2006 | Alesina et al. | 2/93 |
| 2006/0185053 | A1 | 8/2006 | Wittmann et al. | |
| 2006/0277653 | A1 * | 12/2006 | Okajima | 2/93 |

* cited by examiner

*Primary Examiner* — Khoa Huynh
*Assistant Examiner* — Andrew W Collins
(74) *Attorney, Agent, or Firm* — Maginot, Moore & Beck LLP

(57) ABSTRACT

A garment comprises a body fabric having a durable water-repellent finish that substantially resists water entry pressure. At least one vent is provided in an opening in the body fabric. The vent comprises an exterior layer, an interior layer, and a spacer layer positioned between the interior layer and the exterior layer. The exterior layer and the interior layer include a durable water repellent finish that does not substantially resist water entry pressure. The spacer includes a plurality of air passages and separates the interior layer and the exterior layer such that the interior layer does not contact the exterior layer within the vent.

16 Claims, 6 Drawing Sheets

MULTI-LAYER PASSIVE WATER BARRIER SYSTEM

CROSS-REFERENCE TO RELATED APPLICATIONS

This application claims priority from U.S. provisional patent application No. 61/165,219, the contents of which are incorporated herein by reference in their entirety.

FIELD

This application relates to the field of water protection and particularly to water-resistant textiles and clothing.

BACKGROUND

Athletes who train or participate in outdoor sporting activities often use water resistant garments to protect them from rain and other weather. For example, runners often wear water resistant jackets when running in the rain.

Current water protection garments typically include a tightly woven fabric with a durable water repellent (DWR) finish that repels water from the outer surface. In addition to the DWR finish, these fabrics also generally have a barrier technology in the form of a coating or film applied to the back side of the fabric. The barrier results in a monolithic or microporous sheet applied to the fabric that effectively has no open spaces. Accordingly, the barrier blocks substantially all rainwater and air from passing through the fabric. While some barriers have a hydrophilic or microporous quality that allows some small amount of moisture vapor to pass through the barrier, these garments still do not allow air to effectively move through the garment in a manner that provides significant "breathability" to the garment.

During low exertion when the athlete is not producing much sweat, and the athlete's body temperature is relatively low, the barrier on a traditional water-resistant garment will perform in an acceptable manner. However, during high exertion events, traditional barrier technologies cannot effectively manage internal heat and moisture output produced by the athlete. As a result, moisture condenses inside the garment in this heated environment, thus creating clamminess and discomfort for the athlete.

Various attempts have been made to provide a moisture resistant garment that also allows a substantial amount of air to pass through the garment such that it "breathes". For example, rain jackets for runners may include an open mesh portion on the jacket to provide a vent for the runner which allows moisture and heat to escape the inside of the garment. Because rain may strike a runner from any direction, including the front, back and sides, a flap is often provided to at least partially cover the open mesh portion. While the flap may help to keep moisture from passing through the vent, the flap also tends to decrease the amount of air that can flow through the garment and generally reduces the breathability offered by the vent. Also, strong winds may tend to blow the flap open, thus allowing moisture to enter the garment through the open mesh portion.

In view of the foregoing, it would be desirable to provide a water-resistant garment having a venting arrangement that substantially blocks outside moisture from entering the interior of the garment in numerous weather conditions while also offering sufficient breathability for the garment.

SUMMARY

In accordance with one embodiment of the disclosure, there is a garment comprising at least one vent positioned in a tightly woven body fabric. The body fabric may include a durable water-repellent finish that repels surface moisture and having a barrier coating or film that substantially resists water entry pressure. The at least one vent provided in the body fabric comprises an exterior layer, an interior layer, and a spacer layer positioned between the interior layer and the exterior layer. The exterior layer and the interior layer include a durable water repellent finish that repels surface moisture but that does not substantially resist water entry pressure. The spacer includes a plurality of air passages and separates the interior layer and the exterior layer such that the interior layer does not contact the exterior layer within the vent.

When the garment is used in a wet rainy environment, the exterior layer takes the initial water impact and slows it down considerably. Water that does come through the outer layer moves more slowly (through the air passages in the spacer layer) and is shed off the water repellent surface of the inner layer.

The above described features and advantages, as well as others, will become more readily apparent to those of ordinary skill in the art by reference to the following detailed description and accompanying drawings. While it would be desirable to provide a garment that provides one or more of these or other advantageous features, the teachings disclosed herein extend to those embodiments which fall within the scope of any appended claims, regardless of whether they accomplish one or more of the above-mentioned advantages.

DESCRIPTION

The term "garment" as used herein refers to any clothing, covering or accessory that may be worn by a human including, for example, jackets, pants, shirts, shorts, hats, helmets, socks or shoes. The term "durable water repellent" or "DWR", as used herein, refers to a fabric or other material that conforms to the AATCC-22 "meeting or exceeding 80 point rating after 20 washes" standard for water repellency (spray method) as published by the American Association of Textile Chemists and Colorists (AATCC).

Figure 1:
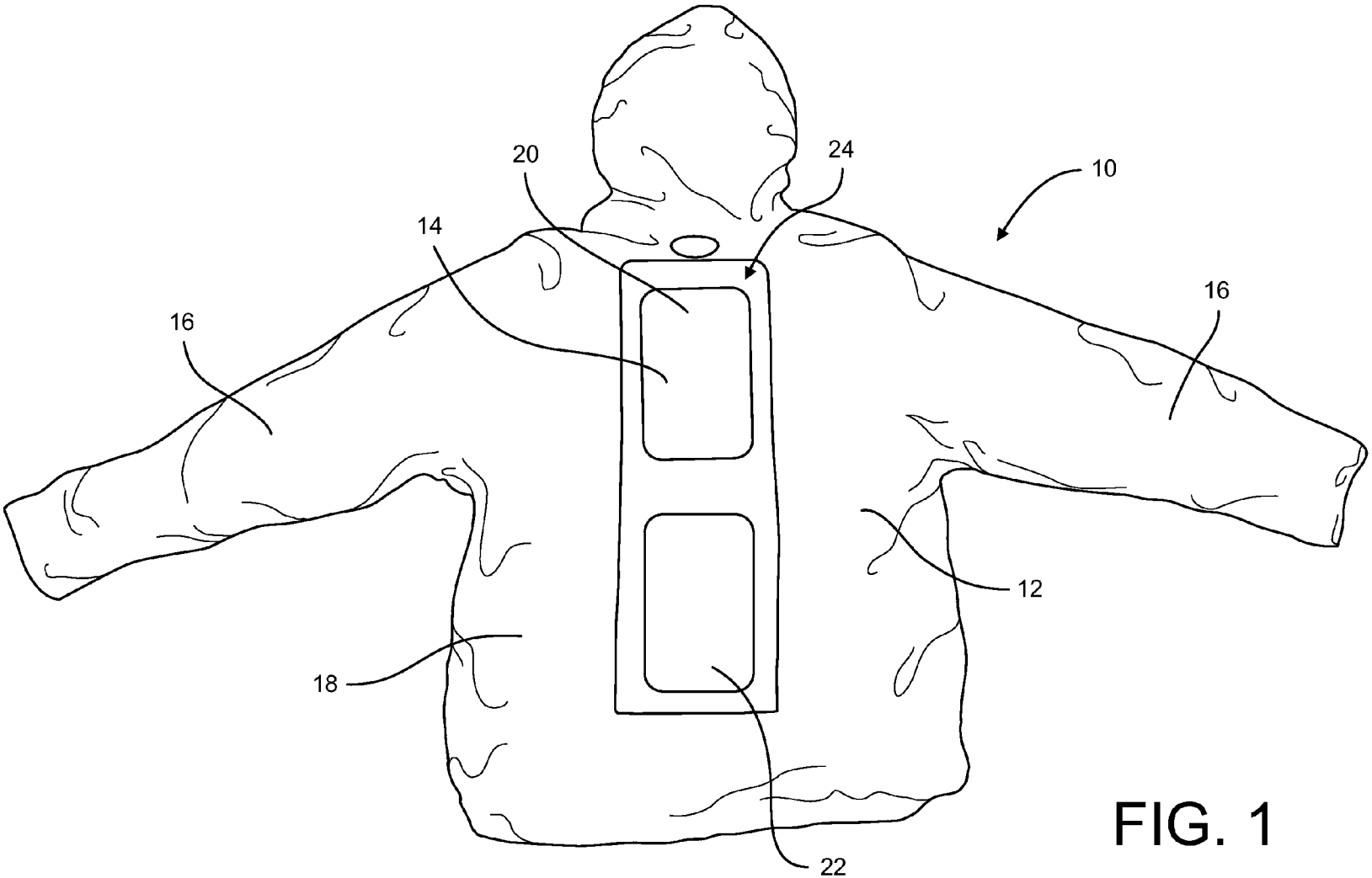
FIG. 1 shows a rear view of a garment including vents configured as a multi-layer passive water barrier.

With reference to FIG. 1, a garment with a multi-layer passive water barrier system is shown as a garment 10 comprised of a body fabric 12 with a plurality of vents 14 formed in the body fabric 12. The body fabric 12 is comprised of a water repellent material. The vents 14 provide for substantial air passage through the garment 10 while also maintaining the water repellent character of the garment 10.

In the embodiment of FIG. 1, the body fabric 12 covers the substantial portion of the garment 10, including the arms 16 and the torso portion 18 of the garment. The body fabric may be comprised of multiple layers. For example a first layer of the body fabric 12 may be a woven fabric layer with a DWR finish and a second layer may be a barrier coating or film lamination on the back side of the woven fabric. The fabric layer is made from multifilament yarns that are woven tightly with the individual filaments of each yarn acting to fill spaces between the weave interlacings. The barrier film or coating on the back side of the garment provides a monolithic or microporous sheet of water resistant material that is substantially void of open spaces. Accordingly, the barrier film or coating on the garment body 12 substantially resists water entry pressure and generally blocks the passage of water and air through the garment body at a given pressure. In at least one embodiment, the body fabric 12 resists water entry pressure in excess of 10,000 mm of water in a water column test.

Examples of barrier films or coatings that may be used in association with the body fabric include GORETEX® and ENTRANT®. The barrier film or coating may be hydrophilic or microporous and allow some moisture vapor to pass through film. Although the barrier may be designed to pass some moisture vapor, it may still be designed to substantially block the passage of air and water through the film. For example, the body fabric 12 with a barrier layer may be configured to resist water pressure in excess of 10,000 mm of water in a water column test.

While the body fabric has been described above as a dual layer fabric including a first layer of woven fabric with a DWR finish and a second layer providing a barrier coating or film lamination, this is only one embodiment of the body fabric and various alternative embodiments of the body fabric are possible. For example, in other embodiments, the body fabric may be a tightly woven textile that may not include a DWR finish and may not include a barrier coating or film. While exemplary body fabrics have been disclosed herein, it will be recognized that the vents 14 described in further detail below may be used in association with any type of body fabric or material for the garment, including woven and non-woven fabrics and materials.

The vents 14 are positioned in openings formed in the body fabric 12. In the embodiment of FIG. 1, two rectangular vents 20 and 22 are positioned on the back of the torso portion 18 of the garment 10. While two vents 20 and 22 are shown in FIG. 1 on the rear of the garment, it will be recognized that a single vent or any number of multiple vents may be included at any of various locations on the garment 10, including, for example, the front, back, arms or sides of the garment. Furthermore, although the vents 20 and 22 are shown in FIG. 1 as rectangular in shape with a particular size, it will be recognized that the vents may also be any of numerous other shapes and sizes.

Figure 2:
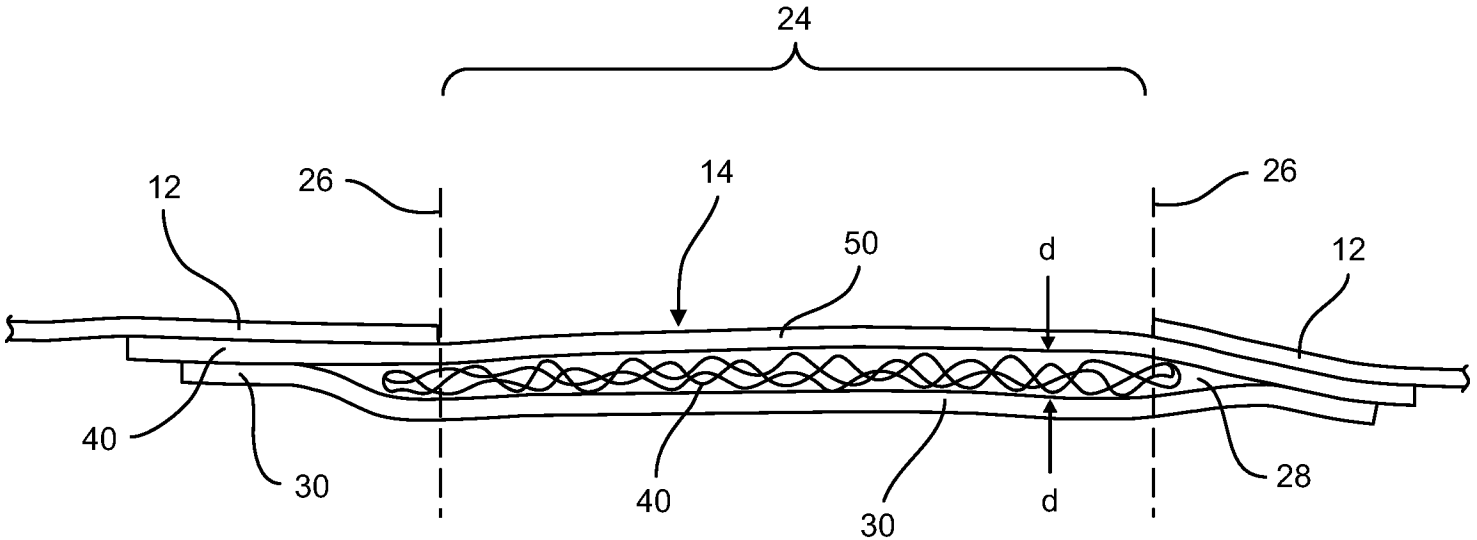
FIG. 2 shows a cross-sectional view of one of the vents of FIG. 1.

Each vent 14 is comprised of multiple layers that together provide the garment 10 with significant breathability while also maintaining the water resistant character of the garment. FIG. 2 shows a cross-sectional view of a vent 14 positioned in an opening 24 in the body fabric 12. As shown in FIG. 2, each vent 14 includes an inner layer 30 and an outer layer 50 separated by a spacer layer 40. The vent 14 is bordered by the edges of the body fabric 12 at the opening 24. The borders 26 of the vent 14 are noted by dotted lines in FIG. 2.

The spacer layer 40 extends throughout the vent 14 and prevents the inner layer 30 from contacting the outer layer 50 at any point within the vent 14. In the embodiment of FIG. 2, the spacer layer 40 extends slightly past the borders 26 of the vent 14 such that the inner layer 30 and outer layer 50 remain separated slightly past the borders of the vent 14.

The inner layer 30, outer layer 50, and body fabric 12 are all joined together past the edges of the spacer layer 40 and thus outside of the area that defines the vent 14. The connection of the inner layer 30 and outer layer 50 results in a pocket 28 that is designed and dimensioned to hold the spacer layer 40 in place in the garment 10. In at least one embodiment, the inner layer 30, outer layer 50, and body fabric 12 are heat welded together at a location on the garment outside of the vents 14. In other embodiments, the inner layer 30, outer layer 50, and body fabric 12 may be joined in other manners as will be recognized by those of skill in the art. For example, the inner layer 30, outer layer 50 and body fabric 12 may be sewn together, or joined with an adhesive.

Figure 3:
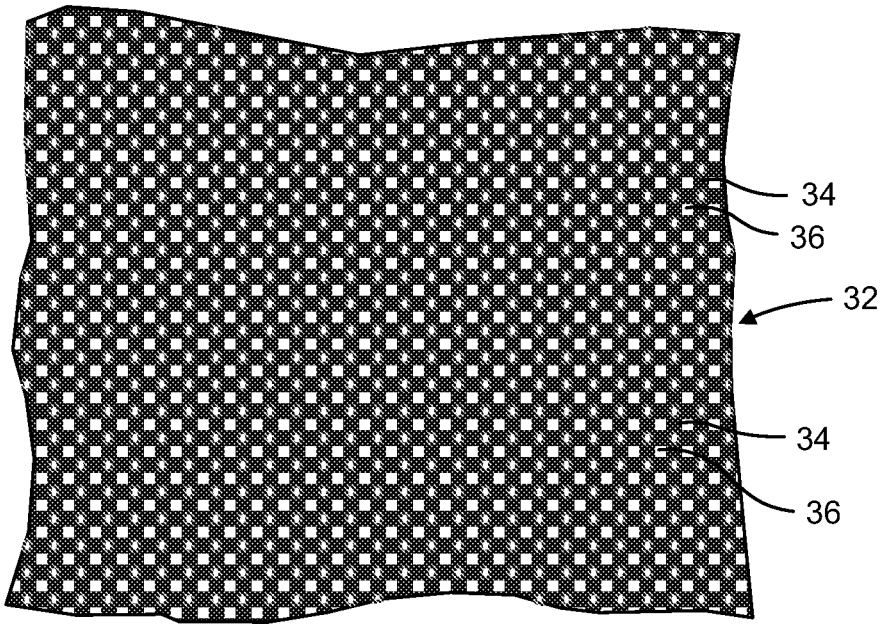
FIG. 3 shows an enlarged view of a fabric forming an inner layer and an outer layer of the vents of FIG. 1.

The inner layer 30 and the outer layer 50 are both comprised of a fine mesh material such as a woven fabric made with monofilament yarns. FIG. 3 shows a magnified view of a woven fabric 32 that may be used to provide the inner and outer layers 30, 50. As shown in FIG. 3, the fabric 32 is tightly constructed, but the single filament yarns 34 allow for very precise spacing at each weave interlacing point, resulting in an array of openings 36. These openings 36 in the fabric 32 provide for air passage through the vents 14. In at least one preferred embodiment, the fabric that comprises the inner and outer layers 30 and 50 has about 37% total open space (i.e., the openings 36 make up 37% of the fabric area). In other embodiments, the fabric has about 30% open space. While an open space of between 25% and 50% is desirable, it will be recognized that the fabric comprising layers 30 and 50 may include other ranges of open space.

Because of the size of the openings 36, the inner and outer layer 30 and 50 will not substantially resist water entry pressure. For example, the inner and outer layers 30, 50 may be such that they will not resist water entry pressure at even 100 mm of water. By contrast, the body fabric 12 resists water entry pressure at a pressure of 1,000 mm of water or even 10,000 mm of water or more.

Even though the inner and outer layers 30 and 50 do not substantially resist water entry pressure, these layers 30 and 50 do both include a finish that lowers the surface energy of the fabric and allows water to roll off the surface. An example of such a finish is a DWR finish such as, for example, a TEFLON® or SCOTCHGUARD® coating that is applied after weaving, such as by dipping the fabric in a bath. Alternatively, the DWR finish on layers 30 and 50 may be applied as a coating to the yarn filaments or otherwise incorporated on the yarn filaments before weaving. In any event, the DWR finish does not result in blockage of the openings 36 in the monofilament fabric. The DWR finish on the fabric of the inner and outer layers 30 and 50 prevents the inner and outer layers 30 and 50 from absorbing any significant amounts moisture. However, some amount of water may be retained within the openings in the fabric of the inner and outer layers 30, 50 in the same way water may be retained in a wire screen. Accordingly, shaking the fabric will promptly remove water retained in the openings 36.

Figure 4:
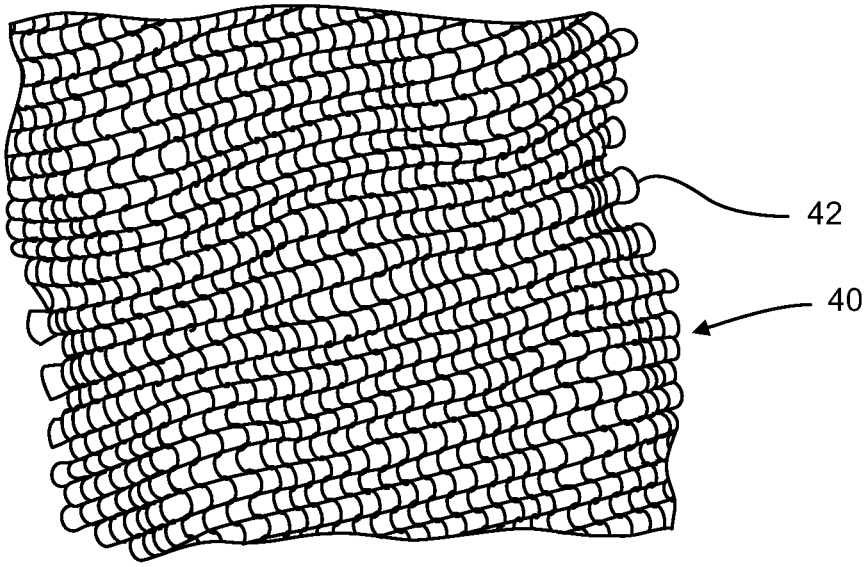
FIG. 4 shows a spacer material provided between the inner layer and outer layer of the vents of FIG. 1.

With reference now to FIGS. 2 and 4, the spacer layer 40 is comprised of a material that fills a volume of space, but is substantially open to allow air to easily move through the spacer layer 40. In the disclosed embodiment, the spacer material is a monofilament material 42 that is resilient yet sufficiently rigid to provide resistance and stable spacing between inner layer 30 and the outer layer 50 of the vent 14. The monofilament material 42 does not absorb moisture and allows for quick drainage. Accordingly, the monofilament may also include a DWR finish. The monofilament material 42 may be provided as a knitted or molded monofilament mesh or a monofilament nonwoven geotextile such as those designed for drainage in civil engineering, buildings, road beds, etc. In at least one exemplary embodiment, the monofilament material may comprise nylon, polyethylene, and/or other polymers. While the foregoing describes exemplary materials that may be used as the spacer layer 40, it will be recognized by those of skill in the art that numerous other materials may also be used, including some multifilament materials.

The spacer layer 40 is positioned in the pocket 28 and completely separates the inner layer 30 from the outer layer 50 in the vent 14. Accordingly, the spacer layer 40 has a thickness that defines a separation distance (noted by arrows "d" in FIG. 2) between the inner layer 30 and the outer layer 50. In at least one embodiment, the spacer layer 40 defines a separation distance of about 3 mm. In other embodiments the spacer layer may define a different distance such as, for example, a distance between about 2 mm and 7 mm.

The volume defined by the spacer layer 40 is preferably as open as possible so as not to interfere with the air flow through the vent 14. In at least one embodiment, the volume bounded by the spacer layer 40 comprises about 95% open space and only about 5% monofilament within that volume. In other exemplary embodiments, the volume bounded by the spacer layer 40 comprises open space in the range of about 80% to about 96%. The open spaces in the spacer layer 40 define a plurality of air passages that allow air to easily flow through the spacer layer.

Figure 5:
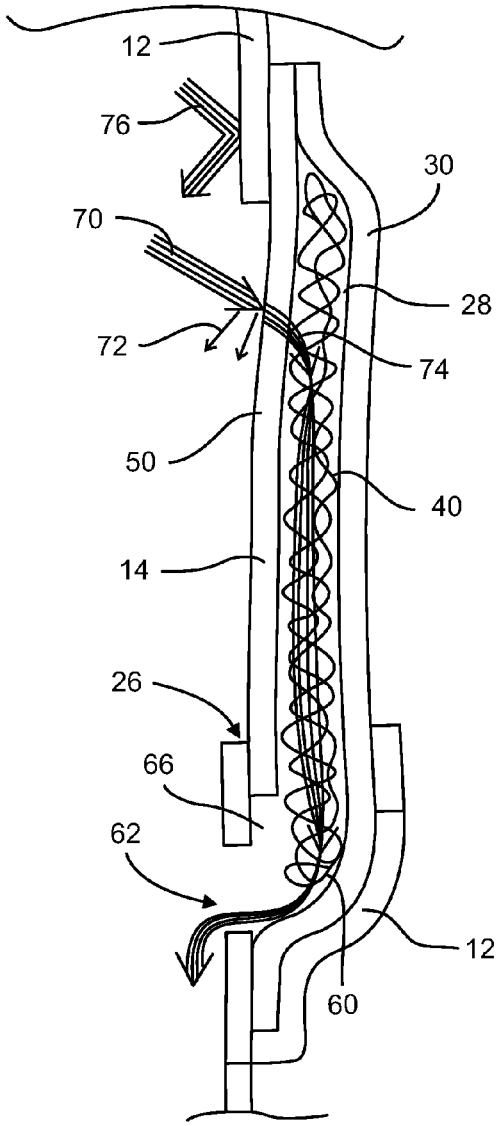
FIG. 5 shows a cross sectional view of a drain arrangement for use with the vent of FIG. 2.

With reference now to FIG. 5, a drain 60 is provided in the garment 10 past the bottom border 26 of the vent 14. The pocket 28 formed between the inner layer 30 and the outer layer 50 leads to the drain 60. In the embodiment of FIG. 5, the drain 60 is provided by a cavity 66 formed between two layers of body fabric 12 at a position below the vent 14. The cavity 66 leads to at least one hole 62 provided in the outer body fabric 12.

Figure 6:
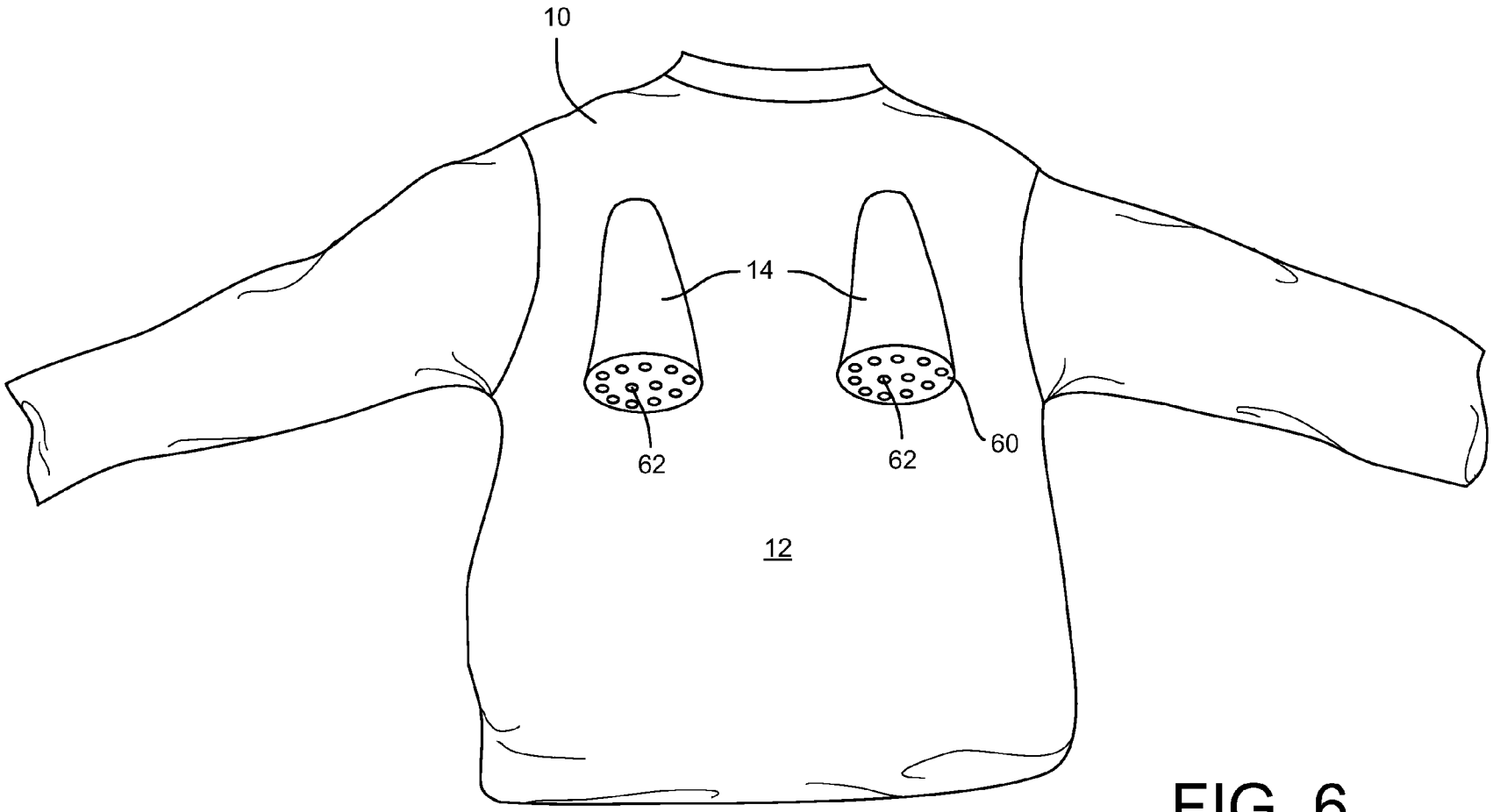
FIG. 6 shows a rear view of a garment including the vent and drain arrangement of FIG. 5.

FIG. 6 shows garment 10 with the vent and drain arrangement of FIG. 5. As can be seen in FIG. 6, a plurality of holes 62 are formed below the vent 14. Water moving downward through the vent 14 is collected in the cavity 66 and passed out of the drain 60 through the holes 62. Water passing through the holes 62 flows down the exterior of the garment along the outer surface of the body fabric 12.

Figure 7:
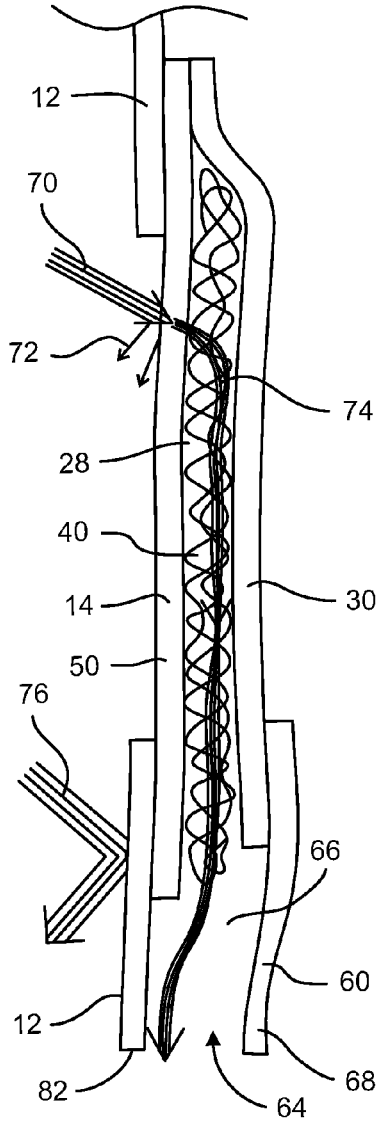
FIG. 7 shows an alternative embodiment of the vent and drain arrangement of FIG. 5.

FIG. 7 shows an alternative embodiment of the vent arrangement of FIG. 5 where the drain is formed at the bottom of the garment by an opening 64 formed between two layers of body fabric 12 provided at the bottom of the garment. In this embodiment, water moving downward through the vent 14 is passed into the cavity 66 of the drain 60. Water in the cavity 66 flows through a passage between the exterior body fabric 12 and an inner drain lining 68 that is also comprised of a DWR fabric or other material that resists water entry pressure. The inner drain lining 68 extends substantially to the bottom of the garment such that water in the drain 60 passes out of the garment at the bottom edge 82 of the garment.

In use, the multi-layer vent 14 provides for substantial air flow through the garment 10 while still maintaining the water resiliency of the garment. The body fabric 12 generally resists water over most of the garment while the vent arrangement 14 allows the garment to easily breathe.

The DWR outer layer 50 of the vent 14 offers a first line of defense designed to both repel water and also reduce the velocity of any water that gets through the outer layer 50. The mostly open space defined by the spacer layer 40 in the middle of the vent 14 maintains a buffer zone between the inner layer 30 and the outer layer 50 that acts to trap any moisture that gets through the outer layer 50. A thicker spacer layer 40 generally results in water coming through and reaching the inner layer 30 at a lower velocity.

The inner layer 30 is the final barrier in the vent 14. Any water coming through the vent to the inner layer 30 moves slowly and will not penetrate the inner layer 30 and will tend to roll off the DWR outer surface of the inner layer 30 within the pocket 28. The drain 60 provided at the bottom of the pocket 28 ensures that any water entering the vent 14 is effectively channeled out of the vent 14 without pooling at the base of the vent or penetrating completely through the vent 14. Accordingly, a garment is provided that offers significant water protection and substantial air flow and wearer comfort using multiple layers of air permeable materials separated by a lightly structured spacer material.

With reference again to FIG. 5, arrows 70, 72, 74 and 76 are used to graphically show the manner in which the garment 10 handles water. In particular, when water strikes the outer layer 50 of the vent 14, some water 72 will be repelled, and other water 74 will enter the pocket 28. The speed of the water entering the pocket 28 is substantially slowed by the outer layer 50. Water entering the pocket 28 either contacts the filaments of the spacer layer 40 or the surface of the inner layer 30 and flows downward in the pocket 28, as indicated by arrow 74. When the water reaches the bottom of the pocket 28, the water enters the drain 60 and flows through the hole 62 in the body fabric 12, and out of the garment 10. As indicated by arrow 76, all water that initially strikes the body fabric 12 is simply repelled by the DWR barrier provided by the body fabric 12.

In the alternative embodiment of the drain arrangement shown in FIG. 6, the drain 60 is formed by an opening 64 provided between two layers of body fabric 12 in the bottom of the garment 10. In this embodiment, water 74 moving into the vent 14 flows downward along the filaments of the spacer layer 40 or along the surface of the inner layer 30 until it reaches the drain 60. The drain 60 simply directs the water to the opening 64 formed in the bottom of the garment between the two layers of body fabric 12, thus causing the water to drip out of the bottom of the garment.

Although certain embodiments of a garment with a multi-layer passive water barrier system have been disclosed herein, it will be appreciated by those of skill in the art that other implementations and adaptations are possible. For example, while the garment has been shown in one embodiment as a jacket with a plurality of vent arrangements, the garment could also be provided as another article, such as pants or shoes having one or more vent arrangements. As another example, it will be recognized that the above-described vent arrangement may be utilized in goods other than garments, such as tents or other sporting goods or accessories. As yet another example, although various exemplary materials and dimensions have been described above for the vent components in the garment, it will be recognized that different materials and dimensions could be used in other embodiments. Furthermore, there are advantages to individual advancements described herein that may be obtained without incorporating other aspects described above. Therefore, the spirit and scope of any appended claims should not be limited to the description of the preferred embodiments contained herein.

What is claimed is:

1. A garment comprising:

a body fabric that substantially resists water entry pressure at a first pressure; and at least one vent positioned in an opening in the body fabric, the vent comprising an exterior layer, an interior layer, and a spacer positioned between the interior layer and the exterior layer, wherein the exterior layer and the interior layer do not substantially resist water entry pressure at the first pressure, wherein the spacer includes a plurality of air passages between the interior layer and the exterior layer, wherein the spacer defines a volume that is mostly open space and separates the interior layer and the exterior layer such that the interior layer does not contact the exterior layer within the vent; and wherein the body fabric, the interior layer, and the exterior layer each include a durable water repellent finish.

2. The garment of claim 1 further comprising a drain configured to receive water from a bottom of the vent.

3. The garment of claim 2 wherein the drain includes at least one opening configured to pass liquid out of the vent and on to an outer surface of the body fabric.

4. The garment of claim 2 wherein the drain includes an inner drain material that substantially resists water entry pressure at the first pressure.

5. The garment of claim 4 wherein the drain includes an opening configured to pass water out of a bottom of the garment through a passage between the inner drain material and the body fabric.

6. The garment of claim 1 wherein the garment is void of a flap or other obstruction that at least partially covers the exterior layer in the vent.

7. The garment of claim 1 wherein the at least one vent is positioned on a back of the garment.

8. The garment of claim 1 wherein the first pressure is at least 1000 mm of water.

9. The garment of claim 1 wherein the volume bounded by the spacer layer comprises between 80% and 96% open space and a remainder of the volume comprises a monofilament material.

10. The garment of claim 1 wherein the spacer layer separates the interior layer of the at least one vent from the exterior layer by a distance of about 2 mm to 7 mm.

11. A garment comprising:

a first material including a durable water repellent finish that substantially resists water entry pressure at a first pressure;

at least one vent positioned on the garment in a vent area that is void of the first material, the vent comprising an outer layer, an inner layer, and a spacer positioned between the inner layer and the outer layer such that the inner layer is separated from the outer layer in the vent area, the outer layer and the inner layer including a durable water repellent finish that does not substantially resist water entry pressure at the first pressure the spacer separating the inner layer and the outer layer within the vent arrangement, the spacer providing a plurality of air passages between the inner layer and the outer layer, wherein the spacer defines a volume that is mostly open space and separates the inner layer and the outer layer such that the inner layer does not contact the outer layer within the vent arrangement.

12. The garment of claim 11 wherein the garment is void of a flap or other obstruction that at least partially covers the outer layer in the vent.

13. The garment of claim 11 wherein the volume bounded by the spacer comprises between 80% and 96% open space.

14. The garment of claim 11 wherein the inner layer and the outer layer are comprised of a mesh material.

15. A garment comprising:

a first material with a durable water repellent finish;

a vent arrangement provided in an area of the garment that is void of the first material, the vent arrangement comprising an inner mesh layer including a durable water repellent finish;

an outer mesh layer including a durable water repellent finish; and a spacer including a durable water repellent finish, the spacer separating the inner mesh layer and the outer mesh layer within the vent arrangement, the spacer providing a plurality of air passages between the inner mesh layer and the outer mesh layer, wherein the spacer defines a volume that is mostly open space and separates the inner mesh layer and the outer mesh layer such that the inner mesh layer does not contact the outer mesh layer within the vent arrangement; and a drain positioned at the bottom of the vent arrangement, the drain configured to pass water out of the vent arrangement;

wherein the garment void of a flap or other obstruction that at least partially covers the vent arrangement.

16. The garment of claim 15 wherein the inner mesh layer and the outer mesh layer include between 25% and 50% open space.

* * * * *